US007083563B1

(12) United States Patent
Long

(10) Patent No.: US 7,083,563 B1
(45) Date of Patent: Aug. 1, 2006

(54) METHOD AND SYSTEM FOR REPLACING WEB FOLDING BOARDS

(75) Inventor: Les Long, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 606 days.

(21) Appl. No.: 09/634,402

(22) Filed: Aug. 9, 2000

(51) Int. Cl.
*B31F 1/10* (2006.01)

(52) U.S. Cl. ..... 493/429; 493/411; 493/446; 493/456; 493/475

(58) Field of Classification Search ..... 493/411, 493/421–440, 446, 447, 456, 475–479, 379–382; 53/359.1, 168; 483/16, 13
See application file for complete search history.

(56) References Cited

U.S. PATENT DOCUMENTS

| | | | | |
|---|---|---|---|---|
| 2,761,676 | A | 9/1956 | Sabee et al. | |
| 3,199,861 | A | 8/1965 | Presnell et al. | |
| 3,285,599 | A | 11/1966 | Pherson et al. | |
| 3,291,479 | A | 12/1966 | Greiner et al. | |
| 3,330,553 | A | 7/1967 | Couzens et al. | |
| 3,401,927 | A * | 9/1968 | Frick et al. | 270/40 |
| 3,472,504 | A * | 10/1969 | Murphy et al. | 270/40 |
| 3,513,743 | A * | 5/1970 | Montguire | 83/433 |
| 4,052,048 | A | 10/1977 | Shirasaka | |
| 4,190,241 | A | 2/1980 | Krueger | |
| 4,327,620 | A * | 5/1982 | Greinke et al. | 83/479 |
| 4,328,655 | A | 5/1982 | Spencer et al. | |
| 4,502,675 | A | 3/1985 | Clark et al. | |
| 4,648,861 | A | 3/1987 | Pierce | |
| 4,650,530 | A | 3/1987 | Mahoney et al. | |
| 4,717,135 | A | 1/1988 | Hathaway | |
| 4,747,813 | A * | 5/1988 | Genoud et al. | 493/10 |
| 5,421,072 | A * | 6/1995 | Kuban | 29/38 A |
| 5,690,263 | A | 11/1997 | Abba et al. | |
| 5,868,276 | A | 2/1999 | Loppnow et al. | |
| 5,992,682 | A | 11/1999 | Loppnow et al. | |
| 6,238,328 | B1 | 5/2001 | Loppnow et al. | |
| 6,422,552 | B1 | 7/2002 | Chesno et al. | |

OTHER PUBLICATIONS

International Search Report (PCTUS01 41635) Jun. 11, 2002.

* cited by examiner

*Primary Examiner*—Stephen F. Gerrity
*Assistant Examiner*—Hermant M. Desai
(74) *Attorney, Agent, or Firm*—Dority & Manning, P.A.

(57) ABSTRACT

A system and method for selectively replacing one set of folding boards for another set of folding boards is provided. The system can include a first frame assembly secured to a first set of folding boards. The first set of folding boards can be initially placed in a web-receiving position for receiving and folding webs, such as tissue webs. The system can also include a second frame assembly secured to a second set of folding boards, which is placed in another position. The first set of folding boards at the web-receiving position can then be selectively replaced by the second set of folding boards. For example, in one embodiment, each frame assembly can be simultaneously rotated about an axis to replace the first set with the second set.

21 Claims, 8 Drawing Sheets

METHOD AND SYSTEM FOR REPLACING WEB FOLDING BOARDS

BACKGROUND OF THE INVENTION

Various types of products, such as facial tissues, napkins, wipes, etc., are folded and stacked, and then cut to length to store in a container or dispenser. For example, facial tissues are commonly folded in a manner such that a consumer can more easily grasp one or more of the tissues from the box. In the past, webs have been folded using a device known as a folding board. For instance, some examples of such folding boards are described in U.S. Pat. No. 4,052,048 to Shirasaka.

A folder generally receives a web and, depending on the design of the folding board, folds the web into a certain configuration. In certain instances, it is often desired to utilize more than one folding board to fold one or more webs. For example, during facial tissue converting, a tissue web is continuously unwound from a roll, redirected by a turning bar, folded, and laid down onto previously folded tissue webs to form a continuous stack of tissues. These operations are carried out in a machine known as a multi-folder that uses multiple folding boards to fold multiple webs.

One problem currently associated with conventional multifolders, however, is that they typically contain only one set of folding boards. To utilize a set of folders having a different size or configuration, the folding boards must be manually interchanged by removing each individual folding board from the line. Unfortunately, such manual interchanging of folding boards can require a substantial amount of time and energy. Moreover, such manual interchanging often results in the misalignment of the folding boards.

As such, a need currently exists for a system and method for more efficiently replacing a set of folding boards with another set of folding boards.

SUMMARY OF THE INVENTION

In accordance with one embodiment of the present invention, a a method for selectively replacing one set of folding boards with another set of folding boards is disclosed. The method includes the steps of placing a first set containing at least two folding boards in a web-receiving position. In some embodiments, the first set and/or second set of folding boards are rotatable about an axis. The method includes the step of selectively transferring the first set of folding boards from the web-receiving position to a first inactive position. Moreover, the method also includes the step of selectively transferring a second set containing at least two folding boards to the web-receiving position such that the folding boards within the second set are simultaneously transferred to the web-receiving position. For example, in one embodiment, the step of selectively transferring the second set of folding boards into the web-receiving position can be accomplished by rotating the second set about an axis such that it moves from a first inactive position to the web-receiving position.

In some embodiments, the method can also include the step of selectively transferring the first set of folding boards from the web-receiving position to a first inactive position. Moreover, in other embodiments, the method can include the step of selectively transferring the first set of folding boards from the web-receiving position to a second inactive position. In such instances, a third set of folding boards may, in some embodiments, be placed in the second inactive position and selectively transferred from the second inactive position to the first inactive position. In one embodiment, the third set of folding boards can also be rotatable about an axis.

In accordance with another embodiment of the present invention, a a method for selectively replacing one set of folding boards with another set of folding boards is disclosed. The method includes the steps of placing a first set of folding boards in a web-receiving position and placing a second set of folding boards in a first inactive position. Each set of folding boards is rotatable about an axis. The method includes the step of selectively rotating the second set of folding boards from the first inactive position to the web-receiving position. Further, the method includes the step of selectively rotating the first set of folding boards from the web-receiving position to either the first inactive position or a second inactive position. In some instances, a third set of folding boards may, in some embodiments, also be placed in the second inactive position and selectively rotated from the second inactive position to the first inactive position.

In accordance with still another embodiment of the present invention, a system for selectively replacing one set of folding boards with another set of folding boards is disclosed. The system includes a first frame assembly secured to a first set of folding boards and a second frame assembly secured to a second set of folding boards. The first frame assembly and/or the second frame assembly can, in some embodiments, contain a frame that is continuous or discontinuous.

Each frame assembly is rotatable about an axis into a web-receiving position. In addition, the second frame assembly is in operative communication with the first frame assembly such that the second frame assembly and the first frame assembly are simultaneously rotatable about an axis. For example, in some embodiments, the first frame assembly and said second frame assembly are connected to at least one mounting arm. In one embodiment, to induce rotation of the first frame assembly and second frame assembly, a rotary actuator can be utilized. In another embodiment, rotation can be induced by a motor.

In some embodiments of the present invention, the system can contain a locking assembly for selectively locking a set of folding boards into the web-receiving position. For example, in one embodiment, the locking assembly includes a locking pin, which may, in some instances, also be provided with an air channel for removing dust from a set of folding boards located at said web-receiving position.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Repeat use of references characters in the present specification and drawings is intended to represent same or analogous features or elements of the invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a method and system for selectively replacing one set of folding boards with another set of folding boards. In one embodiment of the present invention, the system includes a first frame assembly secured to a first set of folding boards and a second frame assembly secured to a second set of folding boards. Each frame assembly is rotatable about an axis such that the assemblies are capable of moving in and out of a web-receiving position. By utilizing a system and method of the present invention, it has been discovered that a set of folding boards can be quickly and efficiently replaced with another set of folding boards.

Figure 1:
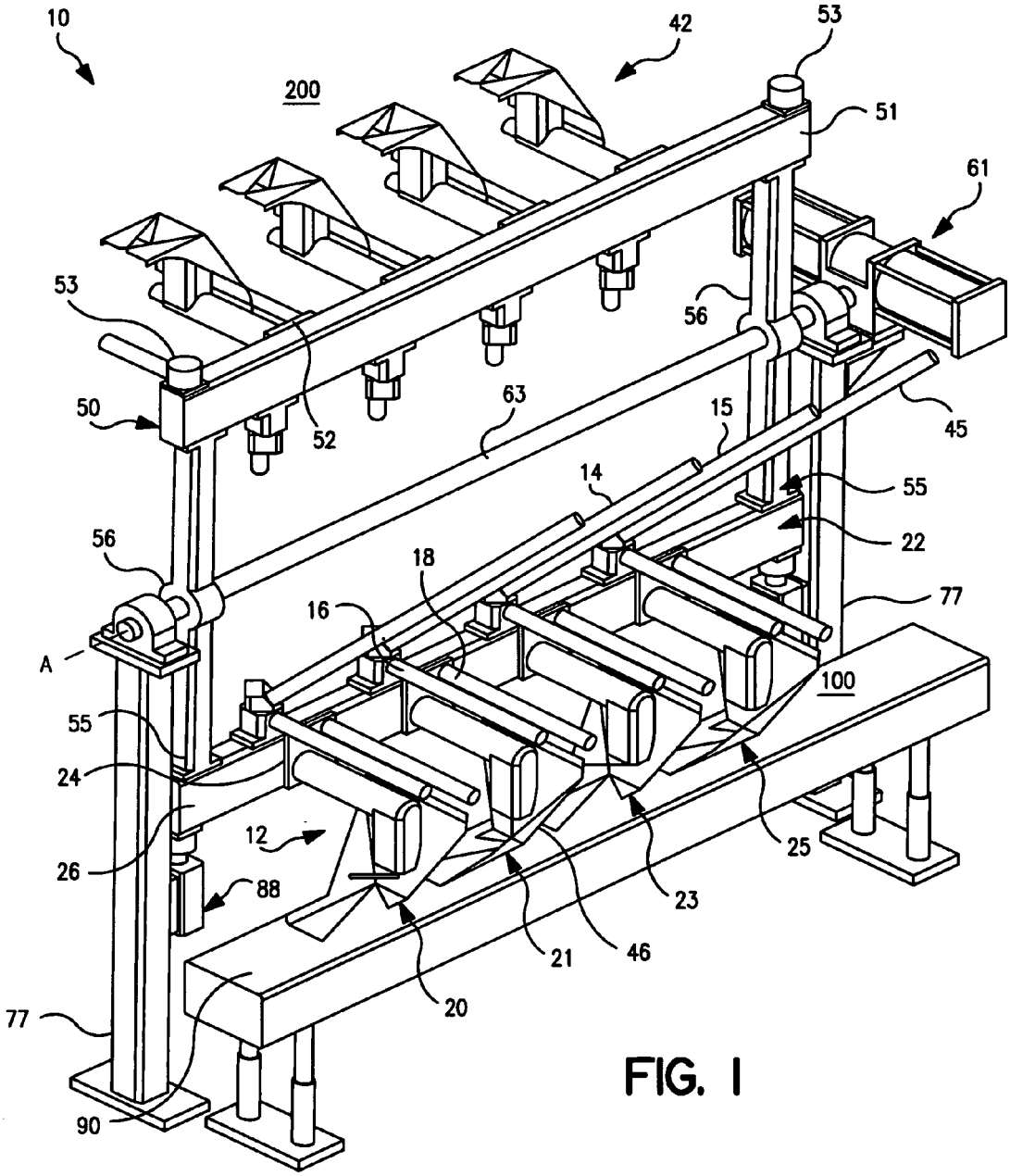
FIG. 1 is a perspective view of one embodiment of a system of the present invention.
Figure 2:
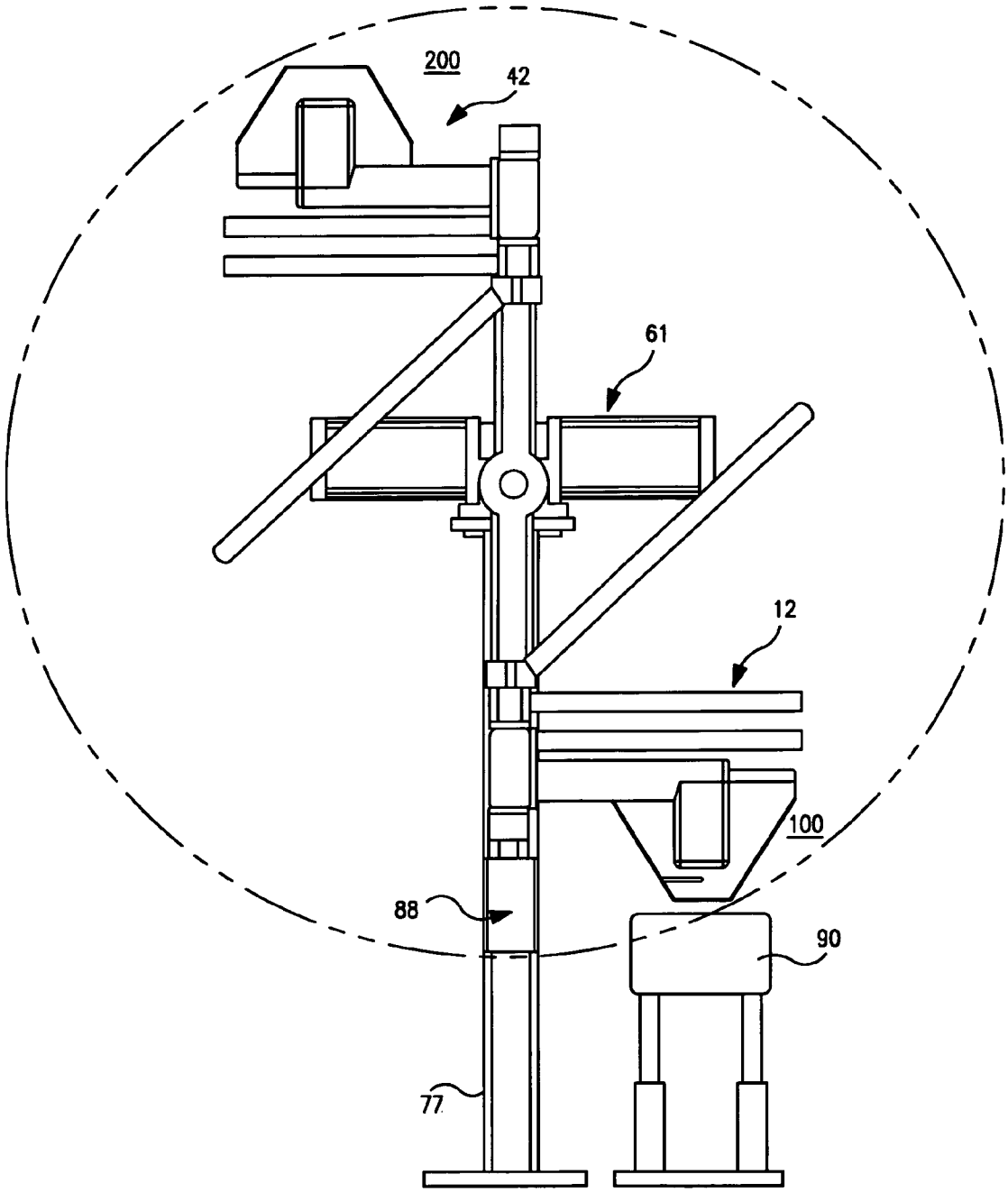
FIG. 2 is a side view of the embodiment of the system depicted in FIG. 1.
Figure 6:
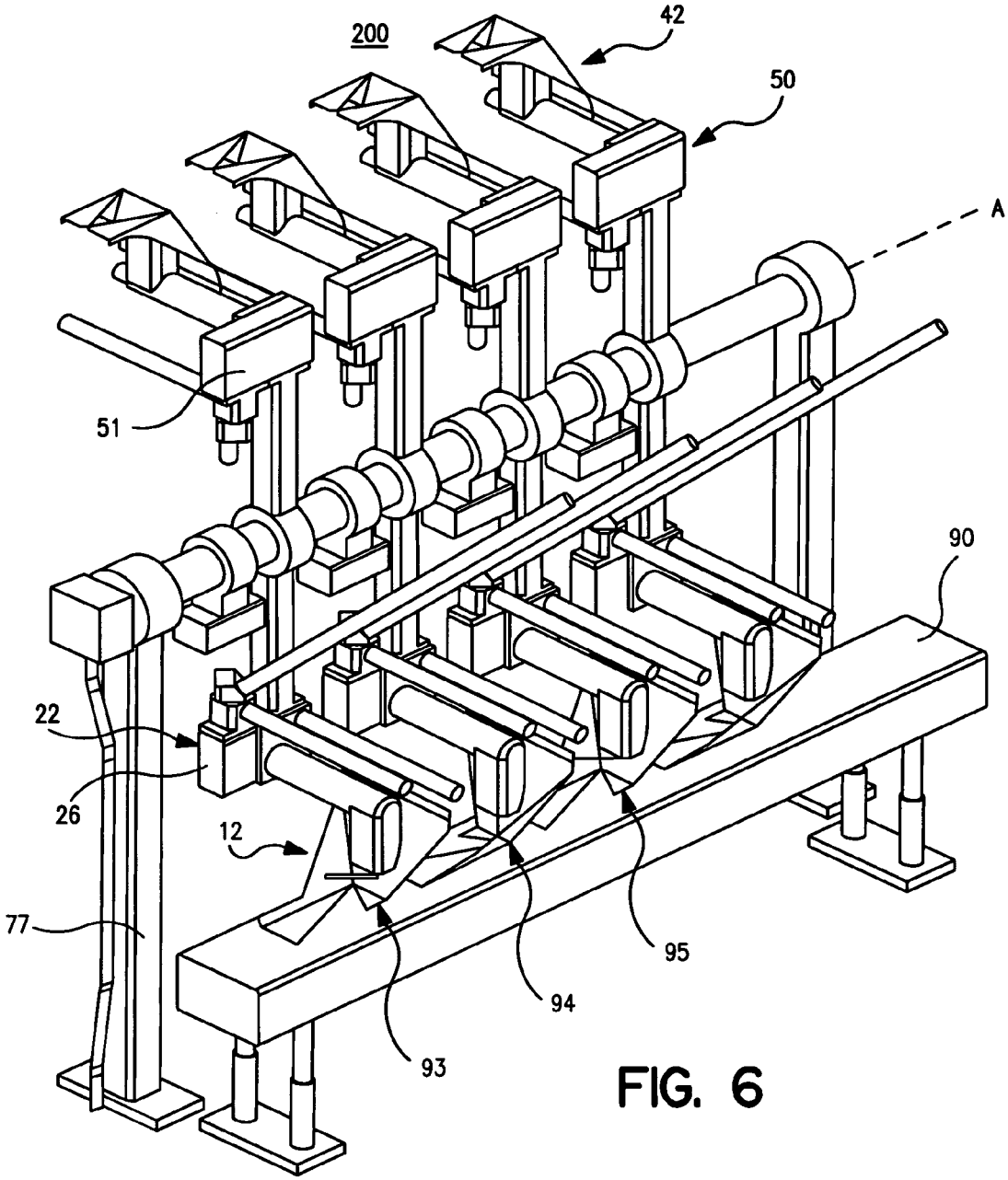
FIG. 6 is a perspective view of still another embodiment of a system of the present invention.

Referring to FIG. 1, for example, one embodiment a system 10 of the present invention is shown that is capable of selectively replacing one set of folding boards for another set of folding boards. As referred to herein, a "set" of folding boards generally includes one or more folding boards. For example, as shown in FIG. 2, a first set 12 can contain four folding boards 20, 21, 23, and 25. In other embodiments, as shown in FIG. 6, a set can include a single folding board 93 or a set can include folding boards 93, 94 and 95.

Any conventional folding board may be utilized in the present invention to impart any type of fold to one or more webs. Specifically, it should be understood that the present invention is not limited to any particular folding board type, size, or design. In fact, any device, assembly, or mechanism that is capable of imparting one or more folds to one or more webs can be utilized as a folding board in the present invention. For example, some suitable folding boards are described in U.S. Pat. No. 3,401,927 to Frick; U.S. Pat. No. 4,052,048 to Shirasaka; U.S. Pat. No. 4,502,675 to Clark, et al.; U.S. Pat. No. 5,868,276 to Loppnow, et al.; and U.S. Pat. No. 5,992,682 to Loppnow, et al., which are incorporated herein in their entirety by reference thereto.

Referring to FIGS. 1–4, some specific examples of folding boards that can be used in the present invention are illustrated. As shown in FIG. 2, the first set 12 includes folding boards 20, 21, 23, and 25. The folding boards 20, 21, 23, and 25 can be designed to fold one or more webs into a variety of different fold configurations. In this embodiment, for example, the folding board 21 is configured to impart an interfolded, V-fold to the web. Moreover, the folding board 25 is configured to impart a conventional C-fold to a web. However, it should also be understood that any other type of fold can be imparted by the folding boards 20, 21, 23, and 25. Moreover, it should also be understood that the folds imparted by the folding boards may be identical or different.

Figure 3:
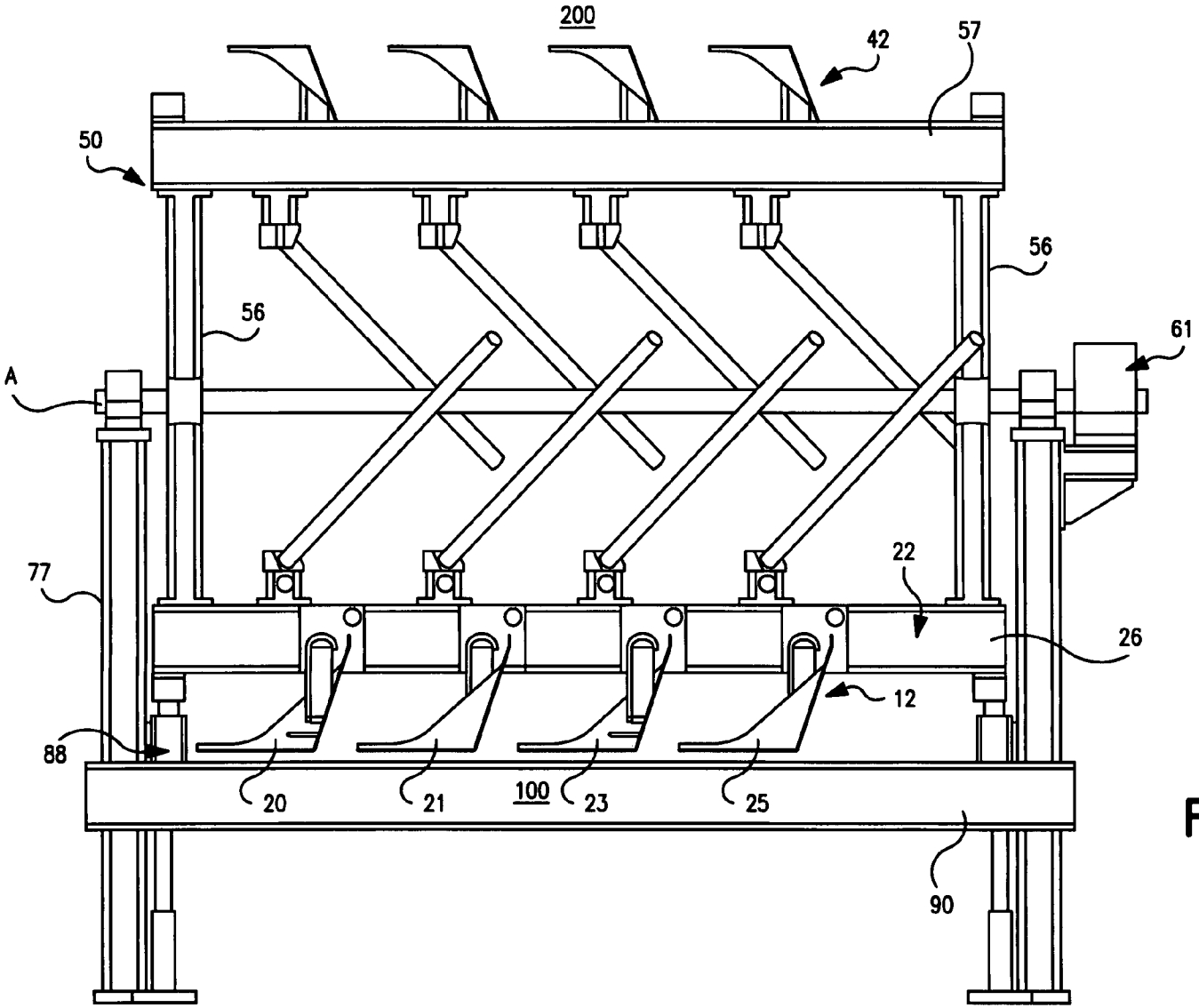
FIG. 3 is a front view of the embodiment of the system depicted in FIG. 1.

Referring to FIG. 1, in one embodiment of the present invention, the first set 12 of folding boards is initially provided in a web-receiving position 100. At the web-receiving position 100, the folding boards of the first set 12 are capable of receiving one or more webs, such as tissue webs, which can be provided by an unwinding roll (not shown). For example, as shown in FIGS. 1–3, two continuous webs can be provided by an unwinding roll (not shown) to be folded by the folding board 21. In one embodiment, the first web can initially pass through guide bars 14 and 15 at an angle of about 45 degrees, while a second web can be passed through guide bars 15 and 45 at an angle of about 45 degrees. Thereafter, the path of the first web is deflected by a turning bar 16 and the path of the second web is deflected by a turning bar 18. From the turning bars 16 and 18, the second web and first web, which is superimposed over the second web, are both maneuvered under a panel 46 of the folding board 21. The folding board 21 then folds the moving webs into a certain fold configuration.

In one embodiment, a second set 42 of folding boards can also be provided in a first inactive position 200. In addition, other sets of folding boards may also be utilized. For example, referring to FIG. 4, a third set 48 of folding boards can be provided in a second inactive position 300. Moreover, referring to FIG. 9, a fourth set 49 of folding arms can be provided in a third inactive position 400. At the first inactive position 200, second position 300, or third position 400, the folding boards are typically not used to fold webs. However, it should be understood that, in some embodiments, a set of folding boards provided at the first inactive position 200, the second inactive position 300, or the third inactive position 400 may be used to fold one or more webs. Moreover, other types of operations may occur at the first inactive position 200, the second inactive position 300, or the third inactive position 400, such as cleaning, sanitizing, etc.

Figure 9:
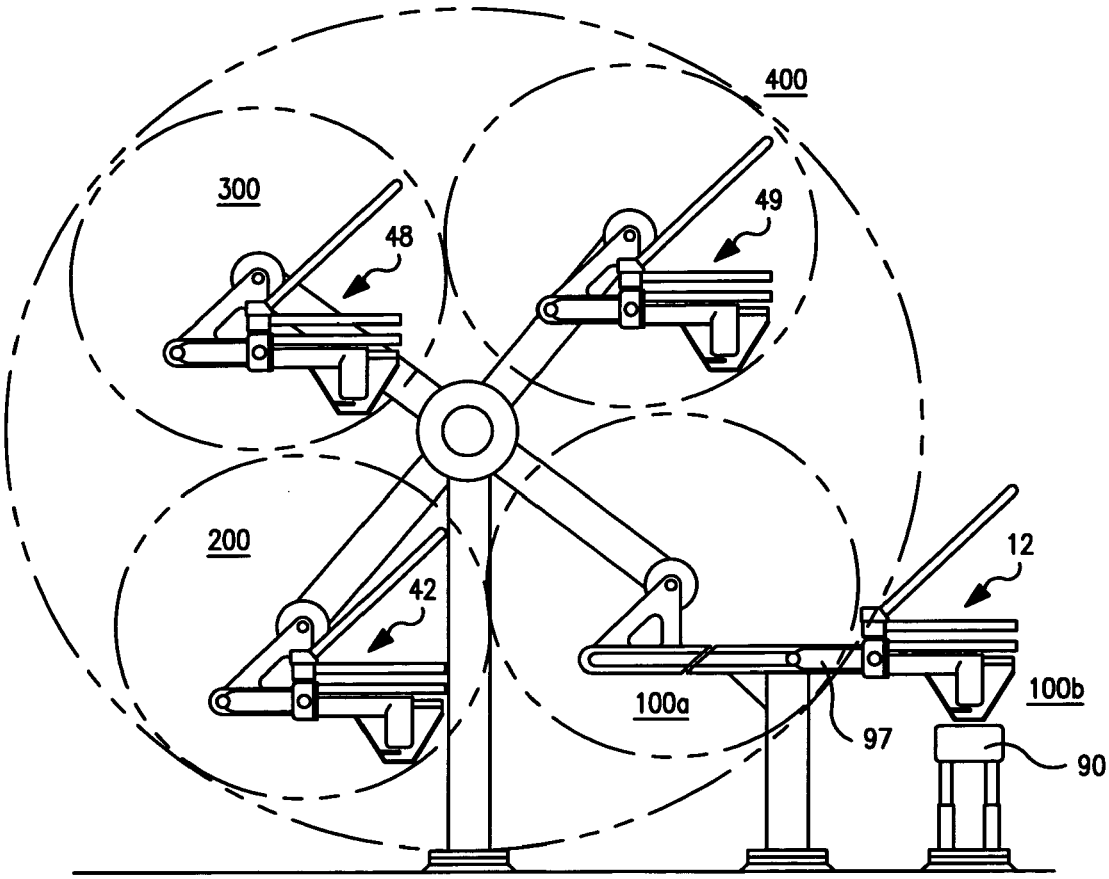
FIG. 9 is a side view of another embodiment of a system of the present invention.

Furthermore, in some embodiments, the web-receiving position 100 can actually contain more than one position. For instance, as shown in FIG. 9, the web-receiving position 100 contains an intermediate position 100*a* and an end position 100*b*. For example, in one embodiment, the first set 12 of folders is placed in an intermediate position 100*a*. At the intermediate position 100*a*, the first set 12 of folding boards can then be moved along a rail 97 into the end position 100*b*, where it can receive one or more webs. In this embodiment, the first set 12 of folding boards has wheels that enable the first set 12 to be more easily moved on a track formed by the rail 97.

In accordance with one embodiment of the present invention, the first set 12 of folding boards can be selectively replaced with the second set 42 of folding boards. For instance, referring to FIGS. 1–3, the folding boards of the first set 12 are each mounted to a frame assembly 22. In this embodiment, the frame assembly 22 includes a frame 26 that is secured to the folding boards via a mounting rail 24. The frame 26 may be continuous, such as shown in FIG. 1, or discontinuous, as shown in FIG. 6. When utilized, for example, a discontinuous frame 26 can allow a set containing the folding boards 93, 94 and 95 to be rotated about the axis A without rotating the other folding boards.

Similarly, the folding boards of the second set 42 are each secured to a frame assembly 50. The frame assembly 50 may include a frame 51 that is secured to the folding boards via a mounting rail 52. The frame 51 may also be continuous or discontinuous, as described above. As shown, in one embodiment the frames 26 and 51 are secured to opposing ends 53 and 55 of two mounting arms 56. In some embodiments, the mounting arms 56 are capable of rotating about an axis A such that the frames 26 and 51 can also be rotated thereabout.

Figure 4:
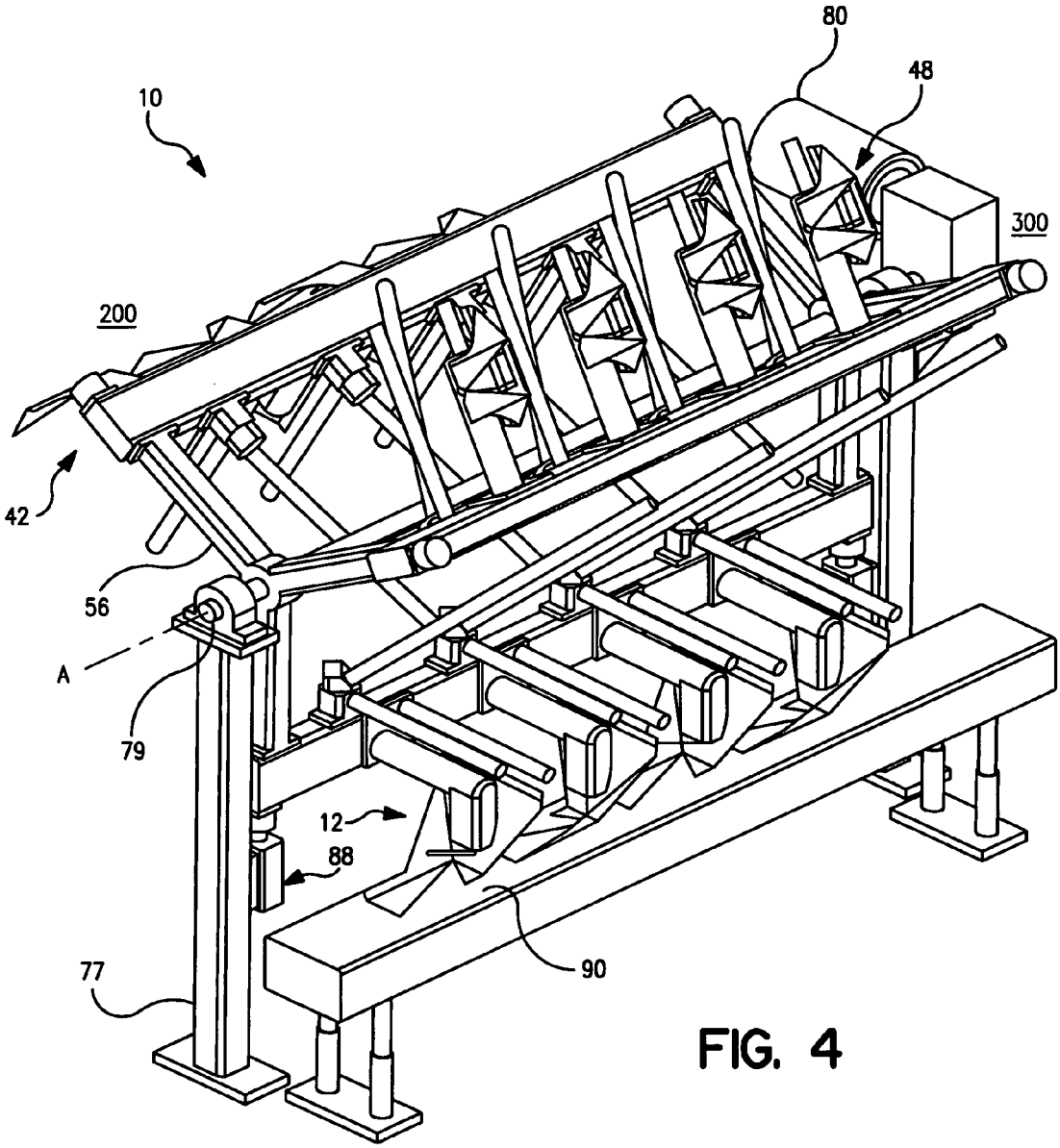
FIG. 4 is a perspective view of another embodiment of a system of the present invention.
Figure 5:
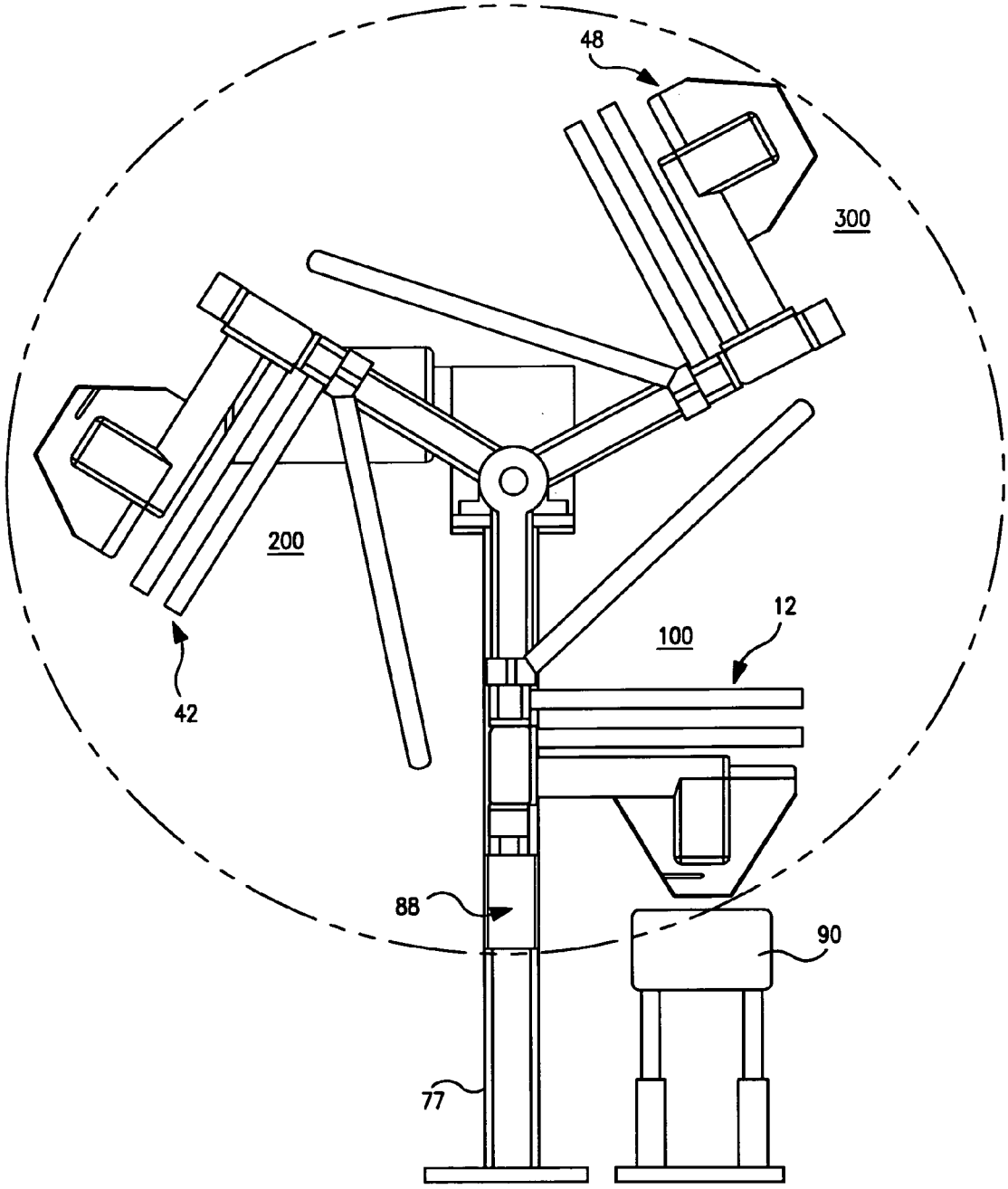
FIG. 5 is a side view of the embodiment of the system depicted in FIG. 4.

For example, as shown in FIGS. 4–5, one embodiment of the present invention includes a rotary actuator 80 that is capable of rotating one or more mounting arms 56 about an axis A. As shown, the mounting arms 56 are rotatably secured to the rotary actuator 80 via a shaft 79. In this embodiment, the rotary actuator 80 is mounted to upstanding members 77 to anchor the system 10 thereto. Any conventional rotary actuator can be utilized in the present invention to impart rotation to the mounting arms 56. For example, one suitable rotary actuator is an HP Series rack-and-pinion rotary actuator made by Parker-Hannifin Corporation.

When utilized, the rotary actuator 80 can rotate the mounting arms 56 approximately 180 degrees in either a clockwise or counter-clockwise direction. For example, a rotary actuator 80 can rotate the mounting arms 56 in a clockwise direction such that the third set 48 of folding boards is rotated to the web-receiving position 100, the second set 42 of folding boards is rotated to the second inactive position 300 and the first set 12 of folding boards is rotated to the first inactive position 200. Moreover, to return the sets of folding boards to their initial positions, the rotary actuator 80 can rotate the mounting arms 56 in a counter-clockwise direction such that the first set 12 of folding boards is located in the web-receiving position 100 and the second set 42 of folding boards is located in the first inactive position 200. In addition to utilizing a rotary actuator 80, manual rotation or any device capable of automatically rotating the mounting arms 56 can generally be utilized. For example, referring to FIG. 1, a motor/gearbox arrangement 61 can also be used to rotate the mounting arm 56 about an axis A. As shown, the mounting arms 56 are rotatably secured to the motor/gearbox arrangement 61 via a shaft 63. In this embodiment, the motor/gearbox arrangement 61 is mounted to upstanding members 77 to anchor the system 10 thereto. Any known motor/gearbox arrangement can generally be utilized to impart rotation to the mounting arms 56. When utilized, the motor/gearbox arrangement 61 can rotate the mounting arms 56 up to 360 degrees in either a clockwise or counter-clockwise direction. For example, a motor/gearbox arrangement 61 can rotate the mounting arms 56 in a clockwise direction such that the second set 42 of folding boards is rotated to the web-receiving position 100 and the first set 12 of folding boards is rotated to the first inactive position 200. Moreover, to return the sets of folding boards to their initial positions, the motor/gearbox arrangement 61 can further rotate the mounting arms 56 in a clockwise direction such that the first set 12 of folding boards is located in the web-receiving position 100 and the second set 42 of folding boards is located in the first inactive position 200.

Figure 7:
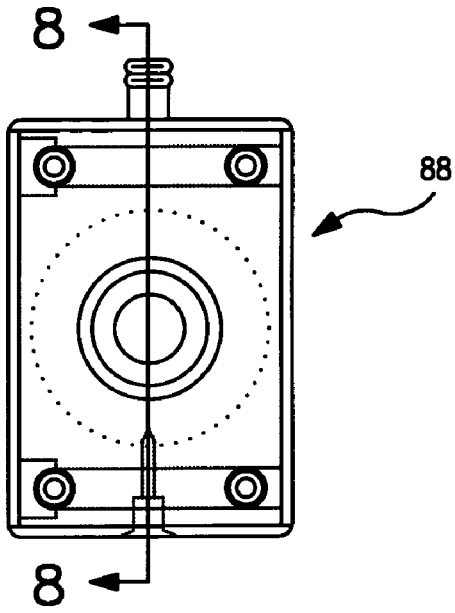
FIG. 7 is a top view of one embodiment of a locking assembly that can be used in the present invention.
Figure 8:
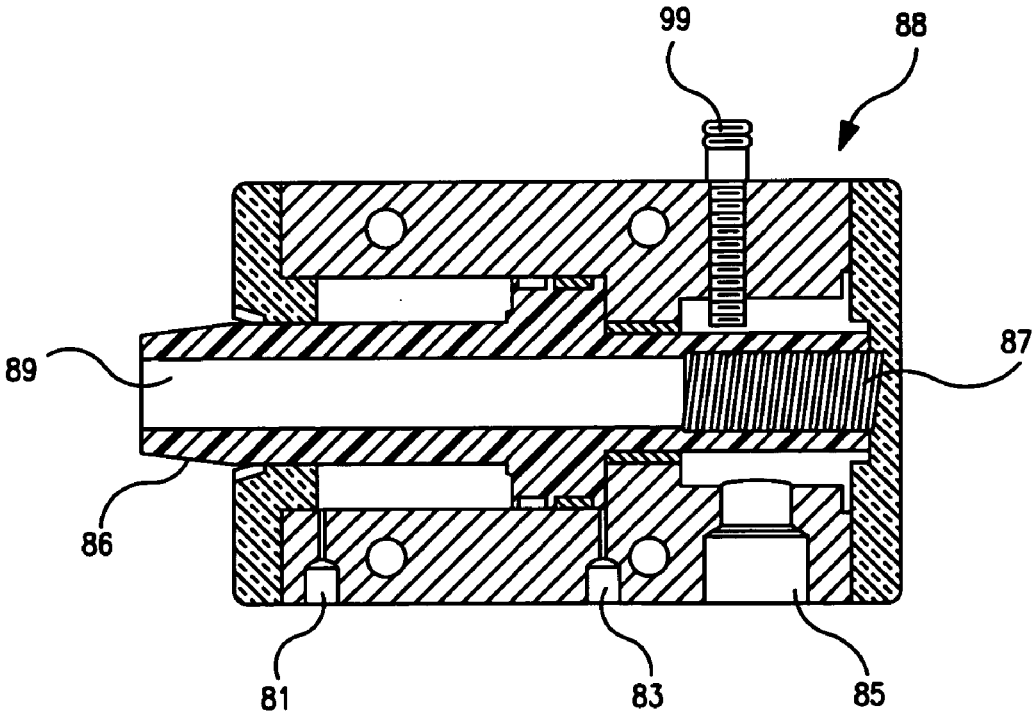
FIG. 8 is a cross-sectional view of the locking assembly shown in FIG. 7 taken along a line 8—8 in FIG. 7.

In some embodiments, once positioned in the web-receiving position 100, the first set 12 or second set 14 of folding boards can be locked into the web-receiving position 100 to ensure adequate alignment of the folding boards with a web. In general, any suitable mechanism for locking a set of folding boards into the web-receiving position 100 can be utilized. For instance, referring to FIGS. 1–8, in one embodiment, a locking pin 86 is utilized to inhibit rotation of the mounting arms 56 so that a set of folding boards can be locked into the web-receiving position 100. In particular, as shown in FIGS. 7–8, the locking pin 86 is movably secured within a locking assembly 88 and can extend into a hollow chamber 84 that is connected to the end 55 of the mounting arms 56. The locking assembly 88 is attached to the upstanding member 77 so that when the pin 86 is extended into the hollow chamber 84 and remains therein, the arm 56 does not rotate further.

In one embodiment, as shown in FIGS. 1 and 7–8, the locking pin 86 can be extended and retracted through the use of air pressure. For example, the locking pin 86 is depicted in FIGS. 7–8 in its retracted state. Air pressure can be supplied to a port 83 to force the pin 86 into the hollow chamber 84 (See FIG. 8). In particular, the air extends the pin 86 in a longitudinal direction (to the left in FIG. 8) into the hollow chamber 84. A spring 87 can be utilized to ensure that the pin 86 remains extended even if the air pressure is released.

To remove the pin 86 from the hollow chamber 84, the air pressure may then be released from the port 83 and supplied to a port 81 so that the pin 86 is forced back into its retracted state, as shown in FIG. 8. The air pressure supplied by the ports 81 and 83 can be provided by an air source (not shown) via hoses 82.

In some embodiments, the system 10 may also be provided with a mechanism for removing dust from various parts of the system. For example, dust commonly accumulates within the guide bars and turning bars. In one embodiment, to remove the dust within these bars, the pin 86 can be provided with an air channel 89 extending in a lengthwise direction through the center of the pin 86. A port 85 can supply air pressure to the air channel 89 when the pin 86 is extended. The pressurized air can flow through the air channel 89 and into one or more of the guide bars and/or turning bars via a hose (not shown) or other similar air transport mechanism.

Once locked into the web-receiving position 100, a set of folding boards can then receive and fold one or more continuous webs. As shown in FIG. 1, for example, the first set 12 of folding boards can receive a web when locked into the web-receiving position 100. To replace the folding boards with other folding boards, the pin 86 can be retracted and the mounting arms 56 can be rotated about an axis A until the second set 42 of folding boards is in the web-receiving position 100. At that point, the second set 42 of folding boards can be locked into position as described above to receive and fold one or more continuous webs.

After being folded, the web(s) can then be stacked and cut for packaging. For example, in one embodiment, as shown in FIG. 1, a conveyor 90 can transport the folded webs to another location. In the embodiment illustrated herein, a lift mechanism (not shown) can raise and/or lower the conveyor 90 so that it is capable of being placed into communication with a web passing through the folding boards. For example, in some instances, the conveyor 90 can be lowered to allow the second set 42 of folding boards to be rotated in a counter-clockwise direction to the web-receiving position 100.

To facilitate the replacement of a set of folding boards, a system of the present invention may also include a variety of control features. For example, one embodiment of the present invention includes at least one controller. The controller can be a programmable logic computer (PLC), such as an Allen-Bradley Controllogix Processor, although any other controller suitable for controlling the system described above, is generally acceptable. Alternately, hard-wired circuitry, relays, software, etc., could be substituted for the PLC and used as the controller.

A controller can generally be utilized to monitor and/or adjust one or more of the attributes of system 10 in response to operator input or to one or more sensors. Referring to FIG. 8, for instance, a sensor 99 is illustrated that can detect the position of the locking pin 86. In particular, before replacing one set of folding boards for another, a controller communicates with the sensor 99 to verify that the locking pin 86 is retracted. Moreover, before feeding one or more webs to a set of folding boards, one or more controllers also communicate with the sensor 99 to verify that the locking pin 86 is extended. Moreover, other sensors, such as photoelectric sensors, can be utilized to detect a variety of system attributes.

In accordance with another aspect of the invention, a related method is provided for selectively replacing a set of folding boards for another set of folding boards. In one embodiment, for example, the method includes the step of placing a first set 12 containing at least two folding boards in a web-receiving position 100. The method further includes the step of placing a second set 42 containing at least two folding boards in a first inactive position 200. The second set 42 of folding boards can then be selectively transferred from the first position 200 to the web-receiving position 100. During transfer, the folding boards within the second set 42 are simultaneously transferred from the first inactive position 200 to the web-receiving position 100. In some embodiments, the first set 12 of folding boards may also be selectively transferred to the first inactive position 200. In other embodiments, the first set 12 of folding boards may be selectively transferred to a second inactive position 300. The step(s) of selectively transferring the second set 42 and/or first set 12 of folding boards may be accomplished by rotating the set(s) about an axis A.

The method and system of the present invention can generally be utilized to fold one or more webs. The webs may be made of the same type or different types. For example, the webs may be paper webs, such as facial tissue, bath tissue, paper towels, and the like, as well as other types of webs, such as wet-wipes, and the like. Further, the webs can also be folded to different widths utilizing a system of the present invention. For instance, in one embodiment, the first set 12 of folding boards can be utilized to form folded tissue webs having a certain width, while a second set 42 of folding boards having a different width can be selectively interchanged therefor to form folded tissue webs of different widths. For example, the first set 12 of folding boards can be utilized to fold tissue webs in a C-fold to a width of about 150 millimeters, while the second set 42 of folding boards can be selectively interchanged with the first set 12 of folding boards to fold tissue webs in a C-fold to a width of about 110 millimeters.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A system for selectively replacing a first set of web folding boards with a second set of web folding boards, said system comprising:

a first frame assembly secured to said first set of web folding boards, said first frame assembly being rotatable about an axis for placing said first set of web folding boards into a web-receiving position for receiving one or more webs;

a second frame assembly secured to said second set of web folding boards, said second frame assembly being rotatable about said axis such that said second set of web folding boards is also capable of being placed into said web-receiving position for receiving one or more webs;

said second frame assembly being in operative communication with said first frame assembly such that said second frame assembly and said first frame assembly are simultaneously rotatable about said axis.

2. A system as defined in claim 1, wherein said first frame assembly and said second frame assembly are connected to at least one mounting arm.

3. A system as defined in claim 1, wherein the rotation of said first frame assembly and said second frame assembly is induced by a rotary actuator.

4. A system as defined in claim 1, wherein the rotation of said first frame assembly and said second frame assembly is induced by a motor.

5. A system as defined in claim 1, further comprising a locking assembly for selectively locking said first set or said second set of web folding boards into said web-receiving position.

6. A system as defined in claim 5, wherein said locking assembly comprises a locking pin.

7. A system as defined in claim 6, wherein said pin is provided with an air channel.

8. A system as defined in claim 1, wherein said first frame assembly comprises a continuous frame.

9. A system as defined in claim 1, wherein said first frame assembly comprises a discontinuous frame.

10. A system as defined in claim 1, wherein said second frame assembly comprises a continuous frame.

11. A system as defined in claim 1, wherein said second frame assembly comprises a discontinuous frame.

12. A system as defined in claim 1, wherein the axis about which the first frame assembly and the second frame assembly are rotatable is a horizontal axis.

13. A system for selectively replacing a first bar and a first set of web folding boards with a second bar and a second set of web folding boards, said system comprising:

a first frame assembly secured to said first bar and said first set of web folding boards, said first frame assembly being rotatable about an axis for placing said first bar and said first set of web folding boards into a web-receiving position for receiving one or more webs;

a second frame assembly secured to said second bar and said second set of web folding boards, said second frame assembly being rotatable about said axis such that said second bar and said second set of web folding boards are also capable of being placed into said web-receiving position for receiving one or more webs, said second frame assembly being in operative communication with said first frame assembly such that said second frame assembly and said first frame assembly are simultaneously rotatable about said axis; and a locking assembly for selectively locking said first set or said second set of web folding boards into said web-receiving position.

14. A system as defined in claim 13, wherein said first frame assembly and said second frame assembly are connected to at least one mounting arm.

15. A system as defined in claim 13, wherein said locking assembly comprises a locking pin.

16. A system as defined in claim 15, wherein said pin is provided with an air channel.

17. A system as defined in claim 13, wherein said first frame assembly, said second frame assembly, or combinations thereof, comprise a continuous frame.

18. A system as defined in claim 13, wherein said first frame assembly, said second frame assembly, or combinations thereof, comprise a discontinuous frame.

19. A system as defined in claim 13, wherein the axis about which the first frame assembly and the second frame assembly are rotatable is a horizontal axis.

20. A system for selectively replacing a first bar and a first set of web folding boards with a second bar and a second set of web folding boards, said system comprising:

a first frame assembly secured to said first bar and said first set of web folding boards, said first frame assembly being rotatable about an axis for placing said first bar and said first set of web folding boards into a web-receiving position for receiving one or more webs;

a second frame assembly secured to said second bar and said second set of web folding boards, said second frame assembly being rotatable about said axis such that said second bar and said second set of web folding boards are also capable of being placed into said web-receiving position for receiving one or more webs, said second frame assembly being in operative communication with said first frame assembly such that said second frame assembly and said first frame assembly are simultaneously rotatable about said axis; and a locking assembly for selectively locking said first set or said second set of web folding boards into said web-receiving position, wherein said locking assembly comprises a locking pin that is provided with an air channel.

21. A system as defined in claim 20, wherein the axis about which the first frame assembly and the second frame assembly are rotatable is a horizontal axis.

* * * * *